United States Patent [19]

Schawbel et al.

[11] Patent Number: 4,815,441

[45] **Date of Patent: * Mar. 28, 1989**

[54] PORTABLE HEATING APPLIANCE

[75] Inventors: William Schawbel; Thaddeus Zaborowski, both of Cambridge, Mass.

[73] Assignee: The Schawbel Corporation, Cambridge, Mass.

[ * ] Notice: The portion of the term of this patent subsequent to Mar. 29, 2005 has been disclaimed.

[21] Appl. No.: 174,789

[22] Filed: Mar. 29, 1988

Related U.S. Application Data

[63] Continuation of Ser. No. 781,262, Sep. 27, 1985, Pat. No. 4,733,651.

[51] Int. Cl.[4] ..... A45D 1/02

[52] U.S. Cl. ..... 126/409; 132/227; 431/89; 431/285; 431/344

[58] Field of Search ..... 126/208, 225, 231, 232, 126/351, 408, 409; 132/33 R, 37 R; 236/92 A; 251/78, 236–238, 242, 321; 431/89, 90, 278, 285, 344

[56] References Cited

U.S. PATENT DOCUMENTS

| | | | |
|---|---|---|---|
| 3,181,789 | 5/1965 | Hill | 236/92 A X |
| 3,574,506 | 4/1971 | Locke | 431/349 |
| 3,887,325 | 6/1975 | Finger et al. | 431/6 |
| 4,243,017 | 1/1981 | Diederich | 126/409 |
| 4,321,934 | 3/1982 | Diederich | 126/409 |
| 4,382,448 | 5/1983 | Tittert | 132/33 R |
| 4,502,465 | 3/1985 | Yashinaga et al. | 126/409 |

FOREIGN PATENT DOCUMENTS

| | | | |
|---|---|---|---|
| WO83-279 | 2/1983 | World Int. Prop. O. | 431/408 |

*Primary Examiner*—Samuel Scott
*Assistant Examiner*—Allen J. Flanigan
*Attorney, Agent, or Firm*—Andrew S. Langsam

[57] ABSTRACT

A portable curling iron having a barrel to be heated, includes first and second burners which heat the barrel; a fuel supply cartridge which supplies fuel to the first and second burners, the cartridge including a fuel delivery valve which controls the flow of fuel from the cartridge; a plunger which applies a force to the valve in response to user actuation, to start the flow of fuel from the cartridge; a regulator assembly including a diaphragm which applies a reverse force to the plunger when the gas pressure exceeds a predetermined pressure, to maintain a substantially constant flow rate of fuel to the first and second burners; a valve stem through which the fuel travels from the cartridge to the second burner; a bimetallic element for applying a force to the valve stem to permit the fuel to pass to the second burner when the temperature is less than a predetermined start-up temperature and for removing such force when the predetermined start-up temperature is attained; and a spring which applies a reverse force to the valve stem to prevent the fuel to pass to the second burner when the predetermined start-up temperature is attained, so as to achieve fast heat up of the barrel without fuel waste.

1 Claim, 2 Drawing Sheets

PORTABLE HEATING APPLIANCE

BACKGROUND OF THE INVENTION

This application is a continuation of application Ser. No. 781,262, filed Sept. 27, 1985, now U.S. Pat. No. 4,733,651.

This invention relates generally to portable heating appliances and, more particularly, is directed to a novel portable curling iron.

A curling iron curls hair by wrapping the hair, tress by tress, around a heated barrel, holding the wrapped tress for a period of time and then unwrapping the tress. The length of time the hair is held wrapped around the barrel, the temperature, the diameter of the barrel and the hair's characteristics largely determine the tightness of the curl.

Some curling irons are portable. These heat the barrel by an electrical heat source or a portable fuel source. Electrical portable curling irons are relatively impractical, but catalytic gas powered curling irons are widely employed. The catalytic converters thereof are powered by butane or similar type gases which may take the form of replaceable or refillable cartridges. Such portable curling irons are widely used, and may be conveniently used almost anywhere.

Catalytic burners for portable curling irons suffer from several disadvantages. First, they are slow to heat and expensive to manufacture, which are clearly undesirable. Additionally, if the temperature runs too high, the platinum catalyst sinters, reducing surface area, which reduces life.

Still further, catalytic converters can suffer from "hot spots" which can render them dangerous.

OBJECTS AND SUMMARY OF THE INVENTION

Accordingly, it is an object of this invention to provide a system for portable devices requiring a heated portion which eliminates the above-mentioned problems.

It is another object of this invention to provide such a system which may be advantageously used in curling irons.

It is still another object of this invention to provide such a system which may be used with portable irons, portable hot trays, hair roller setters, portable bottle warmers as well as many other portable products.

It is yet another object of this invention to provide such a system which is readily adaptable to portable use, yet which permits rapid heating of the element to be heated.

It is a further object of this invention to provide such a system in which the operating temperature is maintained substantially constant.

It is a still further object of this invention to provide such a system in which a source of fuel is employed which may be rechargeable or refillable.

It is a yet further object of this invention to provide such a system in which the element to be heated rapidly achieves the desired temperature, yet in which the temperature is maintained with decreased fuel consumption.

It is another object of this invention to provide such a system which is safe to use.

In accordance with the principles of this invention, the above objects are accomplished by providing a fuel delivery and ignition system for a portable heating appliance which quickly heats the working surface and then reduces the fuel flow when the desired temperature is reached. Additionally, a regulator is provided which controls the fuel rate to maintain a substantially constant temperature of the working surface. Specifically, a piezoelectric ignitor is provided to initially ignite the two burners. After the desired surface temperature is reached, one of the burners is turned off, and the remaining burner continues to operate and maintain the surface temperature substantially constant.

The above and other, objects, features and advantages of the present invention will become readily apparent from the following detailed description which is to be read in connection with the accompanying drawings.

DETAILED DESCRIPTION OF A PREFERRED EMBODIMENT

Figure 1:
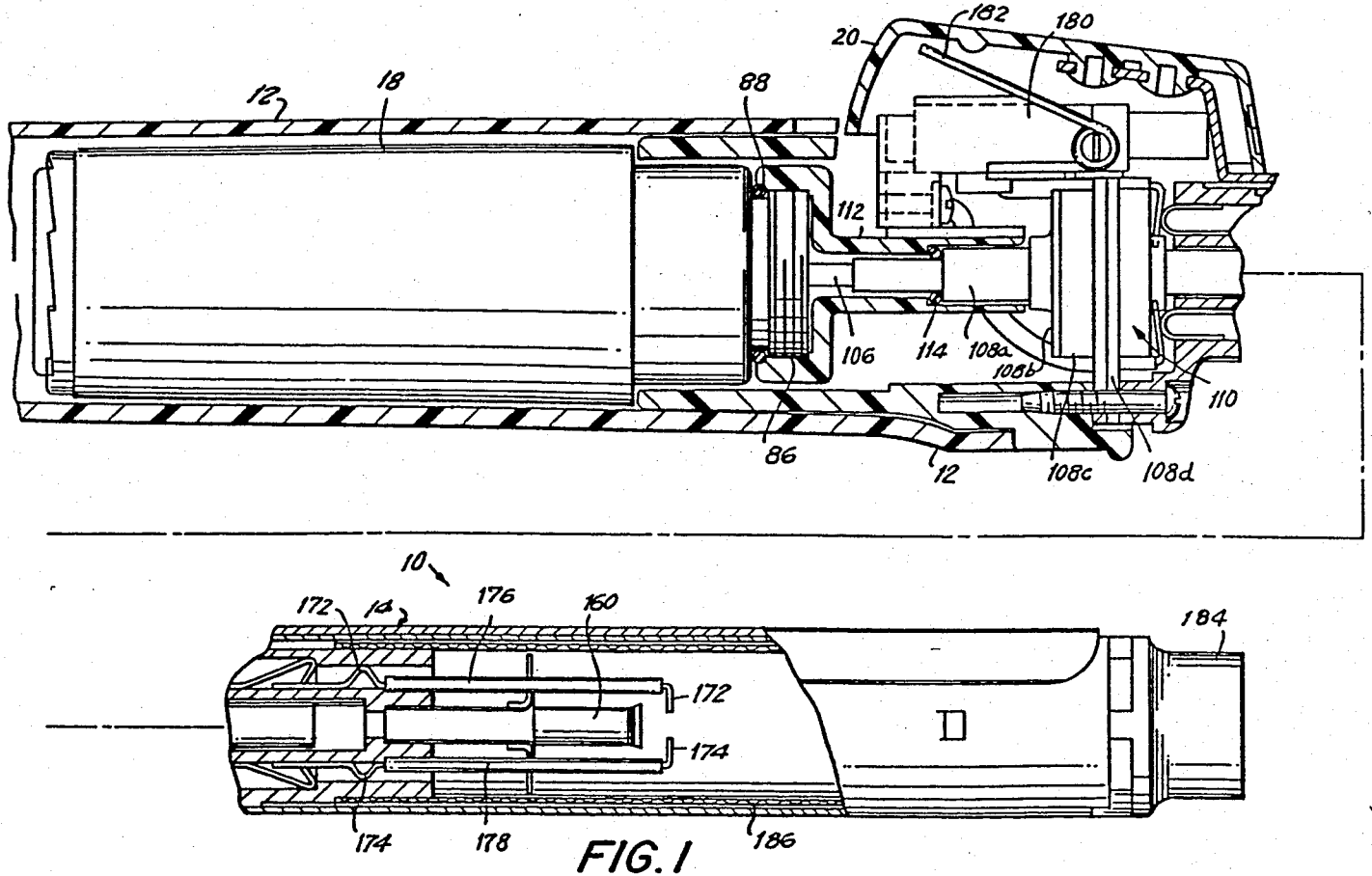
FIG. 1 is a partial cross-sectional view of a portable curling iron according to the present invention in its operative condition.
Figure 2:
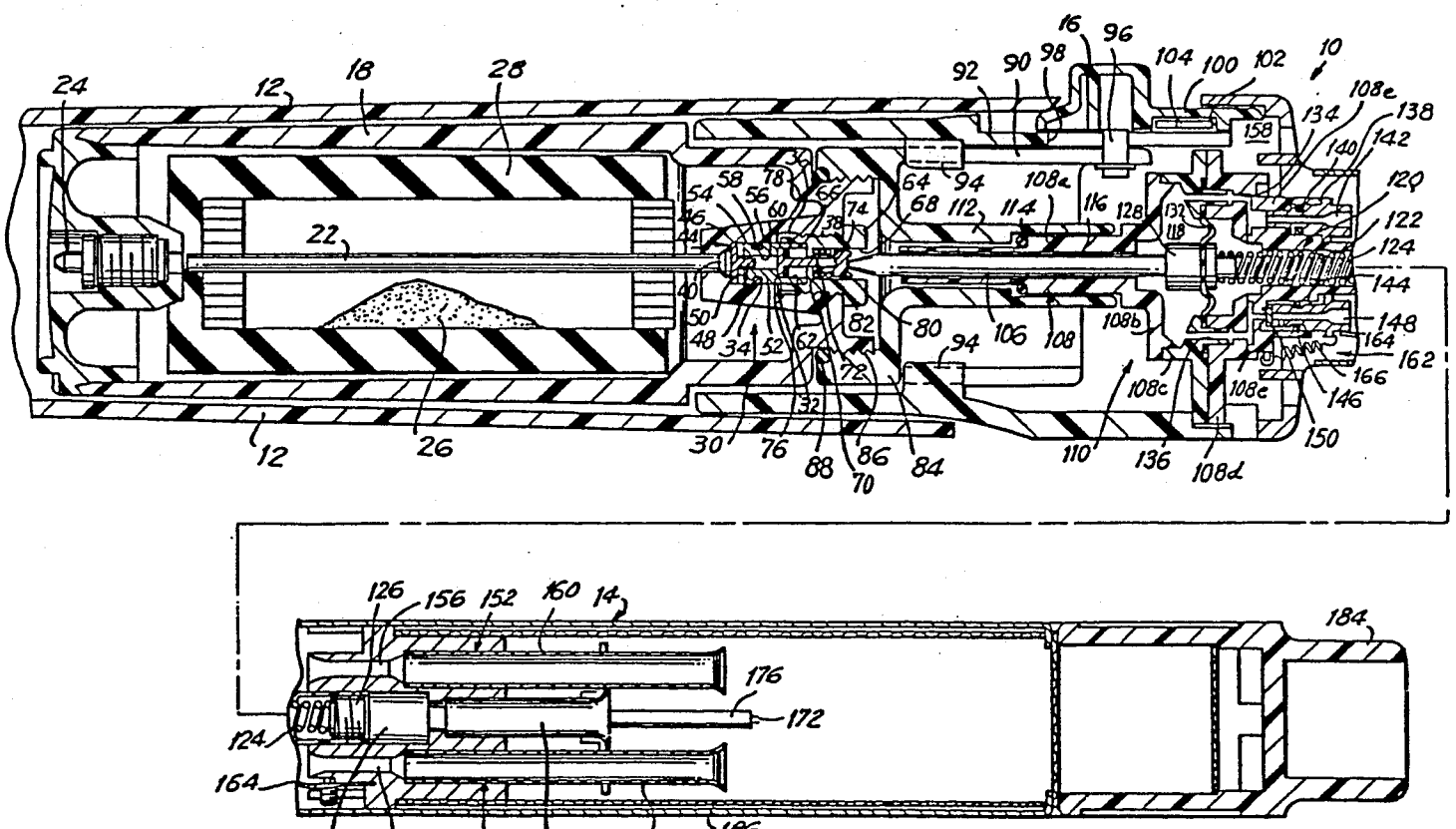
FIG. 2 is a partial cross-sectional view of the portable curling iron of FIG. 1, rotated by 90 degrees from FIG. 1.

Referring to the drawings in detail, a portable curling iron 10 according to the present invention includes a handle 12 which may serve as a cover over a barrel 14 thereof which is to be heated. Handle 12 is shown in FIGS. 1 and 2 in its operative condition, that is, removed from barrel 14. As shown in FIG. 2, when handle 12 is so positioned, it slides a switch button 16 to the right in FIG. 2 to the position shown. Switch button 16, as will be described in greater detail hereinafter, functions as an ON/OFF switch, to start the flow of a gas fuel, such as butane, from a fuel cartridge 18. Then, an ignitor push button 20 (FIG. 1) is depressed by the user to control a piezoelectric ignitor which ignites the butane to heat barrel 14.

As discussed, curling iron 10 is gas fueled, the gas being carried in fuel cartridge 18 and transported to the delivery end by a sintered plastic wick 22. Cartridge 18 may be refillable through a fill valve 24, or replaceable, as desired. As shown in FIG. 2, cartridge 18 includes a charcoal filter material 26 and a foam lining 28, as is conventional.

In addition, cartridge 18 includes a fuel delivery valve 30 at the end opposite fill valve 24. Specifically, fuel delivery valve 30 is assembled in a molded well 32 in the end of cartridge 18 which attaches to curling iron 10. Molded well 32 includes a smooth first section 34 having a first diameter, and a second section 36 having a second, larger diameter which is threaded as at 38.

Fuel delivery valve 30 includes an aluminum wick holder 40 press fit into the inner end of first section 34 of molded well 32. One end of sintered plastic wick 22 is pressed into wick holder 40 and the opposite end of wick 22 extends to near the bottom of cartridge 18 at the opposite end thereof. A cylindrical brass part 44 is positioned within well 32. Cylindrical brass part 44 includes a first section 46 adjacent wick holder 40 and having a diameter substantially equal to that of smooth first section 34, and a second shaft section 48 of a smaller diameter. A tube of compressible foam 50, which forms an adjustable flow restrictor, has a central opening and is located on second shaft section 48 of brass part 44, where the latter centers foam tube 50 within well 32. As will be appreciated from the discussion hereinafter, the degree of compression of foam tube 50 changes the flow rate of gas therethrough.

After the above has been assembled in well 32, the portion of fuel delivery valve 30 which compresses foam tube 50 is assembled in well 32. Specifically, a tubular brass spacer 52 having an outer diameter substantially equal to that of smooth first section 34 of well 32 is slidably fit therein. Spacer 52 includes an end face 54 which abuts against foam tube 50 to compress the same when a force is applied thereto. A circular groove 56 is formed in the outer surface of spacer 52 in which an O-ring 58 is inserted for preventing any leakage between the inner wall of well 32 and the outer surface of spacer 52. Spacer 52 includes a central bore 60 of substantially equal diameter to second shaft section 48 of cylindrical brass part 44 and which slidably fits thereover. Central bore 60 has an enlarged diameter, as at 62, at the opposite end thereof.

A cylindrical molded plastic upper valve housing 64 is provided with external threads which screw threadedly mate with threads 38 of second section 36 of well 32 for securing housing 64 therein. Housing 64 includes a first central, cylindrical recess 66 at one end which surrounds the outer surface of spacer 52, and a second central, cylindrical recess 68 at the opposite end, recesses 66 and 68 being separated by a wall 70 having a central aperture 72 therein. A stem 74 is slidably fit within aperture 72 and includes an enlarged head 76 on the end facing into cartridge 18, enlarged head 76 having an outer diameter substantially equal to that of enlarged diameter section 62 of central bore 60, but slidably fit therein. Thus, stem 74 is shaped like a tiny common nail, but with no sharp point. An annular rubber seal 78 is fit on stem 74 in abutment with enlarged head 76. The opposite end of stem 74 which extends to the opposite side of wall 70, is press fit into a plastic cap 80 which is slidably positioned within second cylindrical recess 68, plastic cap 80 being outwardly biased by a coil spring 82 also positioned within second cylindrical recess 68.

In operation, when no inwardly directed force is applied to plastic cap 80, coil spring 82 outwardly biases plastic cap 80, thereby causing annular rubber seal 78 to be biased to the right of FIG. 2 in contact with and sandwiched between enlarged head 76 and wall 70, to maintain annular rubber seal 78 in compression so as to prevent the flow of any gas from cartridge 18. As will be explained hereinafter, this occurs when cartridge 18 is not assembled with curling iron 10.

When an inwardly directed force is applied to plastic cap 80, the latter moves to the left of FIG. 2 to the position shown, compressing coil spring 82 and moving stem 74, enlarged head 76 and annular rubber seal 78 out of the sealing position, whereby gas can flow out of cartridge 18. The amount of gas flow will depend on the extent that foam tube 50 is compressed. It will be noted that, since housing 64 is screw threadedly received within well 32, the amount of leftward travel of stem 74 and enlarged head 76, and therefore the extent of compression of foam tube 50, will vary depending on the distance that housing 64 is screw threaded into well 32. Housing 64 is shown in FIG. 2 screw threaded to its maximum extent. The gas flow rate is preferably set at the factory and is not consumer adjustable.

As shown, cartridge 18 is secured to a sliding adapter 84 of curling iron 10 through screw threads 86 and is sealed with an O-ring 88 in a conventional manner. Sliding adaptor 84 includes an outer cylindrical section 90 which is slidably keyed within the proximal end of the housing 92 of curling iron 10 by at least one key element 94. Outer cylindrical section 90 is secured to switch button 16. Specifically, switch button 16 includes a switch knob pin 96 which extends through an elongated slot 98 in housing 92. Switch button 16 is also formed with a forward extension 100 having a recess 102 facing housing 92 and in which a switch spring 104 is placed to normally bias switch button 16 to the left of FIG. 2.

Accordingly, when handle 12 is inserted over the proximal end of curling iron 10, it moves switch button 16 to the right of FIG. 2 to the position shown. As a result, cartridge 18 is also moved to the right of FIG. 2 and, as will be described hereinafter, gas flow is started. When handle 12 is removed and placed over barrel 14 to function as a cover, switch spring 104 moves button 16 to the left of FIG. 2, thereby also moving cartridge 18 to the left, to stop the flow of gas.

Specifically, when cartridge 18 is moved to the right of FIG. 2, as shown, a plunger 106 hits against plastic cap 80 to move stem 74 and annular rubber seal 78 out of the aforementioned sealing arrangement to permit the flow of gas. When cartridge 18 is moved to the left of FIG. 2, plunger 106 no longer applies a depressing force to plastic cap 80. As a result, coil spring 82 biases plastic cap 80, stem 74, enlarged head 76 and annular rubber seal 78 to the right of FIG. 2 in the aforementioned sealing arrangement to prevent any flow of gas from cartridge 18.

Plunger 106 is slidably received within a regulator housing 108 of a regulator assembly 110 which, in turn, is slidably received within a central cylindrical section 112 of sliding adapter 84. An O-ring 114 provides a sliding seal between a first section 108a of regulator housing 108 and cylindrical section 112. Thus, gas can only flow from cartridge 18 through a gap 116 provided between plunger 106 and first section 108a of regulator housing 108.

The purpose of regulator assembly 110 is to provide vaporized fuel at constant pressure independent of ambient temperature, fuel consumption rate, orientation, brand of fuel and fuel level. Thus, a known amount of heat is produced at all times, corresponding to fuel consumption. Therefore, temperature regulation is not necessary to maintain barrel temperature during use and because of this, curling iron 10 according to the present invention is easier to assemble and adjust than prior butane curling irons.

As shown in FIG. 2, first section **108*a* of regulator housing 108 includes a radially directed section 108*b* at the end thereof which extends from cylindrical section 112. Radially directed section 108*b* is connected to a second section 108*c* of regulator housing 108 which, in turn, is connected to a third section 108*d* thereof. The latter section 108*d* is connected to still a fourth section 108*e* of regulator housing 108. Of course, all of the sections of regulator housing 108 can be constructed in a one piece molding operation. Radially directed section 108*b* and second, third and fourth sections 108*c*, 108*d* and 108*e*, respectively, define a gas flow chamber 118 through which gas flows from gap 116 between first section 108*a* of regulator housing 108 and plunger 106**.

Regulator assembly 110 further includes an inner assembly 120 within chamber 118 and which defines a central bore 122 which houses a coil spring 124. An adjusting screw 126 is screw threadedly received within central bore 122, against which one end of coil spring 124 abuts. A plunger stopper 128 is secured to one end of plunger 106, and includes a central boss 130 at the opposite end thereof. The opposite end of coil spring 124 surrounds and is centered by boss 130 and abuts against the respective end face of plunger stopper 128. Thus, coil spring 124 pushes on plunger 106, biasing it in the direction of cartridge 18 into abutment with plastic cap 80 of fuel delivery valve 30 when cartridge 18 is secured to curling iron 10. Butane gas therefore flows from cartridge 18, through gap 116 to chamber 118.

A rubber diaphragm 132 is secured to inner assembly 120 and to plunger stopper 128. When the pressure of the fuel entering chamber 118 becomes too great, rubber diaphragm 132 is biased to the right of FIG. 2 against the force of coil spring 124, to move plunger 106 away from fuel delivery valve 30, whereby coil spring 82 of fuel delivery valve 30 causes it to close, halting the flow of gas. Once the gas pressure is reduced by burning the fuel, coil spring 124 moves rubber diaphragm 132 and plunger 106 to the left of FIG. 2 to the position shown, to once again open fuel delivery valve 30. This cycle continues and maintains a constant pressure on the outlet side of regulator assembly 110 as long as switch 16 remains in the ON position. It will be appreciated that, turning adjusting screw 126, alters the compression of coil spring 124, thus adjusting the gas flow pressure.

Regulator housing 108 and inner assembly 120 define two narrow channels 134 and 136 therebetween through which gas from chamber 118 escapes, each channel leading toward a respective orifice-venturi-burner assembly. Specifically, channel 134 leads to a valve stem 138 positioned within a recess defined between fourth section 108e of regulator housing 108 and inner assembly 120. An O-ring 140 surrounds valve stem 138 at mid-length to provide a gas tight seal. Valve stem 138 includes a central bore which defines a gas flow orifice 142 in fluid communication with channel 134.

In like manner, a valve stem 144 is positioned within a recess defined between fourth section 108e of regulator housing 108 and inner assembly 120, diametrically opposite valve stem 138. An O-ring 146 surrounds valve stem 144 at mid-length to provide a gas tight seal. In addition, valve stem 144 includes a central bore which defines a gas flow orifice 148 in fluid communication with channel 136. An annular, resilient valve pad 150 is positioned at the end of valve stem 144 between channel 136 and orifice 148. As will be appreciated from the description which follows, O-ring 146 acts as the fulcrum of a lever, whereby valve stem 144 can rotate or rock thereabout to make or break a seal between channel 136 and orifice 148, by means of valve pad 150. Thus, when valve stem 144 is axially in line with barrel 14, there is no gas seal, and butane vapors flow from channel 136, through the central aperture of valve pad 150 to orifice 148. On the other hand, when valve stem 144 is tilted or rotated about O-ring 146, the central aperture of valve pad 150 is out of line with channel 136 and orifice 148, so that a seal is provided which blocks the passage of gas to orifice 148.

The butane vapor from orifice 142 leads to a main burner 152, while the butane vapor from orifice 148 leads to a fast heat up burner 154. The burners differ in purpose, and each will be discussed beginning with main burner 152.

The purpose of main burner 152 is to provide enough heat to maintain barrel 14 at a desired temperature during use. After the butane vapor leaves orifice 142, it passes through a venturi tube 156, where air supplied from an annular chamber 158 is entrained to make a combustible mixture. Orifice 142 is of sufficient size to increase the velocity of the butane vapor so that the correct amount of air for efficient burning will be entrained in venturi tube 156. The size of the orifice determines how much fuel enters each burner at a given pressure. The amount of fuel determines the heat up rate and equilibrium temperature attained. The air-butane vapor mixture then travels down a stainless steel tube 160 to the opposite end thereof where ignition and combustion occur. There, the fuel is ignited by an electric spark when the ignition push button 20 is pressed, and burns as long as ON/OFF switch button 16 is ON.

The purpose of the fast heat up burner 154 is to reduce the time required to heat barrel 14 from ambient to working temperature. It differs from main burner 152 by virtue of a thermostatically controlled valve assembly 162 which allows fuel to flow until barrel 14 reaches a predetermined temperature at which point a bimetallic element 164 thereof, secured to barrel 14 and to valve stem 144, deflects, and a spring 166 secured to fourth section 108e of regulator housing 108 and valve stem 144, pivots valve stem 144 about O-ring 146, whereby valve pad 150 provides a seal to prevent fuel flow through orifice 148 of valve stem 144. When barrel 14 is not at the predetermined temperature, bimetallic element 164 applies a force to valve stem 144, normal to its axis and against the force of spring 166, to maintain orifice 148 of valve stem 144 in its open condition, whereby butane vapor enters orifice 148 and then travels through a venturi tube 168 where it is entrained with air from annular chamber 158. As with orifice 142, orifice 148 is of sufficient size to increase the velocity of the butane vapor so that the correct amount of air for efficient burning will be entrained in venturi tube 168. The air-fuel mixture from venturi tube 168 travels down a stainless steel tube 170 to the opposite end thereof where ignition and combustion occur. The heat produced by fast heat up burner 154 approximately doubles the heat output of curling iron 10. Of course, with orifice 148 closed by thermostatically controlled valve assembly 162, there is no combustion and therefore no heat.

Therefore, the burner system consists of two parallel paths, each with the same capacity, but one being controlled by regulator assembly 110 and bimetallic element 164 and the other being controlled by regulator assembly 110 alone. Each path terminates in a stainless steel tube 160 or 170 having an open end where the air-gas mixture is ignited and burned.

Ignition is accomplished by an electric spark traveling from electrodes 172 and 174 to the ends of stainless steel tubes 160 and 170, where combustion takes place, as shown in FIG. 1. Specifically, electrodes 172 and 174 are encased partially in ceramic tubes 176 and 178, respectively, with the ends thereof being exposed at the ends of stainless steel tubes 160 nd 170, as shown. The opposite ends of electrodes 172 and 174 extend into electrical contact with a piezoelectric crystal 180 which generates a spark when struck by a spring loaded hammer 182 when ignition push button 20 is pressed. Ignition push button 20 is mounted between cartridge 18 and regulator assembly 110, measured in the lengthwise direction of curling iron 10, so that ignition push button 20 is next to ON/OFF switch button 16.

Thus, to operate curling iron 10, handle 12 is removed from barrel 14 and positioned over cartridge 18, where it biases switch button 16 to the right of FIG. 2, to turn ON the flow of butane gas. Then, ignition push button 20 is pressed once or twice to ignite the gas-air mixture at the end of stainless steel tubes 160 and 170. Initially, both burners 152 and 154 are activated to quickly bring barrel 14 up to the predetermined temperature. Once this temperature is attained, bimetallic element 164 deflects and spring 166 pivots valve stem 144 about O-ring 146 to prevent the flow of gas therethrough, and thereby shut off fast heat up burner 154. The predetermined temperature is then maintained by regulator assembly 110 which is initially set for the particular desired temperature. As the gas flow increases too much, whereby the temperature also rises, the gas flow is cut off, until the pressure in chamber 118 decreases (corresponding to the desired temperature).

A cool tip 184 is located on the open end of barrel 14. It is molded of high temperature resistant plastic which is also low in thermal conductivity. This component provides a gripping surface, and because it is tubular in shape, exhaust gases escape through is screened open end.

Further, the combustion area of curling iron 10 is surrounded by an expanded aluminum or wire woven screen 186. The purpose of screen 186 is to even out the temperature of the exhaust gases, all of which must pass through it. Additionally, exhaust ports (not shown) in barrel 14, which are conventional, have screens (not shown) of the same expanded aluminum, yielding a double flame arresting barrier against hot exhaust gases (even during ignition). Thus, curling iron 10 can be started and run in an explosive atmosphere of common household solvents with no danger of curling iron 10 starting a fire or explosion.

Although the present invention has been described for use with a curling iron, clearly, the fuel supply, regulator assembly and fast heat up and main burners are useable in many environments in which fast heat up and settable barrel temperatures are desirable. The following products are a representative list of those which could readily use the above elements either alone or in combination:

1. Curling iron
2. Travel setter
3. Facial hand unit
4. Travel flat iron
5. Travel flat iron with steam
6. Clothes dewrinkler
7. Contact lens sterilizer
8. Travel hot plate
9. Hot tray
10. Gas match
11. Lantern
12. Bottle warmer
13. Hot liquids container
14. Hot bladed knife
15. Solder iron
16. Hot melt gun
17. Travel stove
18. Pocket hands warmer
19. Paint stripper
20. Heat massager It will also be appreciated that the regulator assembly has independent value and can be used without the two burner system. In like manner, the two burner system can be used without the regulator assembly.

Having described a specific preferred embodiment of the invention with reference to the accompanying drawings, it is to be appreciated that the present invention is not limited to that precise embodiment and that various changes and modifications can be effected therein by one of ordinary skill in the art without departing from the spirit and scope of the invention as defined by the appended claims.

What is claimed is:

1. A portable heating appliance having a member to be heated, comprising:

burner means for heating said member;

a portable fuel container for supplying fuel to said burner means, said container including fuel delivery valve means for controlling the flow of fuel from said container, said fuel delivery valve means including control means for preventing the flow of fuel when in a first position and for permitting the flow of fuel when in a second, different position, and first biasing means for biasing said control means to said first position;

actuator means for actuating said fuel delivery valve means in response to user actuator to enable the flow of fuel from said container, said actuator means including plunger means which pushes in said control means from said first position to said second position against the force of said biasing means to open said fuel delivery valve means so that the latter permits the flow of fuel to said burner means; and control means for maintaining a substantially constant heat level for said member.

* * * * *